US010995386B2

(12) United States Patent
Arlazarov et al.

(10) Patent No.: US 10,995,386 B2
(45) Date of Patent: May 4, 2021

(54) DOUBLE ANNEALED STEEL SHEET HAVING HIGH MECHANICAL STRENGTH AND DUCTILITY CHARACTERISTICS, METHOD OF MANUFACTURE AND USE OF SUCH SHEETS

(71) Applicant: ArcelorMittal, Luxembourg (LU)

(72) Inventors: Artem Arlazarov, Maizieres-les-Metz (FR); Jean-Christophe Hell, Maizieres-les-Metz (FR); Frédéric Kegel, Maizieres-les-Metz (FR)

(73) Assignee: ArcelorMittal, Luxembourg (LU)

( * ) Notice: Subject to any disclaimer, the term of this patent is extended or adjusted under 35 U.S.C. 154(b) by 1031 days.

(21) Appl. No.: 15/312,974

(22) PCT Filed: May 7, 2015

(86) PCT No.: PCT/IB2015/000651
§ 371 (c)(1),
(2) Date: Nov. 21, 2016

(87) PCT Pub. No.: WO2015/177615
PCT Pub. Date: Nov. 26, 2015

(65) Prior Publication Data

US 2017/0101695 A1 Apr. 13, 2017

(30) Foreign Application Priority Data

May 7, 2015 (WO) ..... PCT/IB2015/000651

(51) Int. Cl.

| | |
|---|---|
| ***C21D 9/46*** | (2006.01) |
| ***C21D 9/48*** | (2006.01) |
| ***C21D 8/04*** | (2006.01) |
| ***C22C 38/02*** | (2006.01) |
| ***C22C 38/04*** | (2006.01) |
| ***C22C 38/12*** | (2006.01) |
| ***C23C 2/28*** | (2006.01) |
| ***C23C 2/40*** | (2006.01) |
| ***C22C 38/00*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 2/02*** | (2006.01) |
| ***C23C 2/06*** | (2006.01) |
| ***C23C 2/12*** | (2006.01) |
| ***C23F 17/00*** | (2006.01) |

(52) U.S. Cl.
CPC ..... *C21D 9/48* (2013.01); *C21D 8/0405* (2013.01); *C21D 8/0426* (2013.01); *C21D 8/0436* (2013.01); *C21D 8/0447* (2013.01); *C21D 8/0463* (2013.01); *C21D 8/0478* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C23C 2/02* (2013.01); *C23C 2/06* (2013.01); *C23C 2/12* (2013.01); *C23C 2/28* (2013.01); *C23C 2/40* (2013.01); *C23F 17/00* (2013.01); *C21D 9/46* (2013.01); *C21D 2211/001* (2013.01); *C21D 2211/002* (2013.01); *C21D 2211/008* (2013.01)

(58) Field of Classification Search
CPC ..... C21D 9/48
See application file for complete search history.

(56) References Cited

U.S. PATENT DOCUMENTS

| | | | |
|---|---|---|---|
| 6,537,394 | B1 | 3/2003 | Osawa et al. |
| 9,011,614 | B2 | 4/2015 | Nakagaito et al. |
| 9,650,708 | B2 | 5/2017 | Becker et al. |

(Continued)

FOREIGN PATENT DOCUMENTS

| | | | |
|---|---|---|---|
| CN | 1341154 | A | 3/2002 |
| CN | 101065509 | A | 10/2007 |

(Continued)

OTHER PUBLICATIONS

P Puomi, H.M Fagerholm, J.B Rosenholm, K Jyrkäs, Comparison of different commercial pretreatment methods for hot-dip galvanized and Galfan coated steel, Surface and Coatings Technology, vol. 115, Issue 1, 1999, pp. 70-78. (Year: 1999).*

C. Garcia-Mateo, F.G. Caballero, 1.09—Advanced High Strength Bainitic Steels, Editor(s): Saleem Hashmi, Gilmar Ferreira Batalha , Chester J. Van Tyne, Bekir Yilbas, Comprehensive Materials Processing, Elsevier, 2014, pp. 165-190. (Year: 2014).*

Sugimoto et al.:"Fatigue strength of newly developed high-strength low alloy TRIP-aided steels with good hardenability," Procedia Engineering 2 (2010) 359-362; Fatigue 2010, Apr. 2010.

*Primary Examiner* — Jophy S. Koshy
(74) *Attorney, Agent, or Firm* — Davidson, Davidson & Kappel, LLC

(57) ABSTRACT

A double-annealed steel sheet is provided. The composition of which includes, expressed in percent by weight, 0.20%≤C≤0.40%, 0.8%≤Mn≤1.4%, 1.60%≤Si≤3.00%, 0.015≤Nb≤0.150%, Al≤0.1%, Cr≤1.0%, S≤0.006%, P≤0.030%, Ti≤0.05%, V≤0.05%, B≤0.003%, N≤0.01%. A remainder of the composition includes iron and unavoidable impurities resulting from processing. The microstructure of the steel sheet includes, in area percentages, 10 to 30% residual austenite, 30 to 60% annealed martensite, 5 to 30% bainite, 10 to 30% fresh martensite and less than 10% ferrite A fabrication method and vehicle parts are also provided.

18 Claims, No Drawings

(56) References Cited

U.S. PATENT DOCUMENTS

| | | | |
|---|---|---|---|
| 2004/0238080 | A1 | 12/2004 | Vandeputte et al. |
| 2008/0131305 | A1 | 6/2008 | Okitsu |
| 2009/0053096 | A1 | 2/2009 | Vliura et al. |
| 2009/0277547 | A1 | 11/2009 | Saito et al. |
| 2011/0146852 | A1 | 6/2011 | Matsuda et al. |
| 2011/0198002 | A1 | 8/2011 | Nakagaito et al. |
| 2012/0312433 | A1 | 12/2012 | Mizuta et al. |
| 2013/0095347 | A1 | 4/2013 | Kawasaki et al. |
| 2014/0170439 | A1 | 6/2014 | Allain et al. |
| 2014/0234660 | A1 | 8/2014 | Kawata et al. |
| 2014/0238557 | A1 | 8/2014 | Haga et al. |
| 2014/0241933 | A1 | 8/2014 | Haga et al. |
| 2015/0086808 | A1 | 3/2015 | Kasuya et al. |
| 2016/0160309 | A1 | 6/2016 | Allain et al. |

FOREIGN PATENT DOCUMENTS

| | | | |
|---|---|---|---|
| CN | 101120114 | A | 2/2008 |
| CN | 101460644 | A | 6/2009 |
| CN | 101460647 | A | 6/2009 |
| CN | 103781932 | A | 5/2014 |
| CN | 103797135 | A | 5/2014 |
| EP | 1365037 | B1 | 11/2003 |
| EP | 1571230 | A1 | 9/2005 |
| EP | 2325346 | A1 | 5/2011 |
| EP | 2524970 | A1 | 11/2012 |
| GB | 2491958 | A | 12/2012 |
| JP | H01272720 | A | 10/1989 |
| JP | 2002302734 | A | 10/2002 |
| JP | 2004250774 | A | 9/2004 |
| JP | 2010285636 | A | 12/2010 |
| JP | 2012229466 | A | 11/2012 |
| JP | 5418047 | B2 | 2/2014 |
| JP | 5821260 | B2 | 11/2015 |
| KR | 20140012167 | A | 1/2014 |
| KR | 20140052072 | A | 5/2014 |
| RU | 2318911 | C2 | 3/2008 |
| WO | WO2013146148 | | 10/2013 |
| WO | WO2015011511 | | 1/2015 |

* cited by examiner

DOUBLE ANNEALED STEEL SHEET HAVING HIGH MECHANICAL STRENGTH AND DUCTILITY CHARACTERISTICS, METHOD OF MANUFACTURE AND USE OF SUCH SHEETS

The present invention relates to the manufacture of double annealed, high-strength steel sheets that have simultaneously a mechanical strength and a ductility that make it possible to carry out cold-forming operations. More particularly, the invention relates to steels that have a mechanical strength greater than or equal to 980 MPa, a yield stress greater than or equal to 650 MPa, uniform elongation greater than or equal to 15% and elongation at break greater than or equal to 20%.

BACKGROUND

The strong demand for the reduction of greenhouse gas emissions combined with increasingly strict requirements for automotive safety and rising fuel prices have given the producers of motor-driven land vehicles an incentive to make increasing use of steels that offer improved mechanical strength in the body of their vehicles to reduce the thickness of parts and therefore the weight of the vehicles while maintaining the mechanical strength performance of the structures. To this end, steels that combine high strength and sufficient formability for forming without the appearance of cracks are becoming increasingly important. Over the course of time and in succession, numerous families of steels have therefore been proposed that offer various levels of mechanical strength. These families include DP (Dual Phase) steels, TRIP (Transformation Induced Plasticity) steels, Multiphase steels and even low-density steels (FeAl).

To respond to this demand for increasingly lighter-weight vehicles, it is therefore necessary to have increasingly strong steels to compensate for the low thickness. In the field of carbon steels, however, it is known that an increase in mechanical strength is generally accompanied by a loss of ductility. In addition, the producers of motorized land vehicles are designing increasingly complex parts that require steels that exhibit high levels of ductility.

EP1365037A1 describes a steel that contains the following chemical components in percent by weight: C: from 0.06 to 0.25%, Si+Al: from 0.5 to 3%, Mn: from 0.5 to 3%, P: 0.15 or less, S: 0.02% or less, and also optionally containing at least one of the following components in percent by weight: Mo: 1% or less, Ni: 0.5% or less, Cu: 0.5% or less, Cr: 1% or less, Ti: 0.1% or less, Nb: 0.1% or less, V: at least 0.1%, Ca: 0.003% or less and/or REM: 0.003% or less, combined with a microstructure composed principally of tempered martensite or tempered bainite representing 50% or more in area percentage, or tempered martensite or tempered bainite that represents 15% or more with regard to a space factor in relation to the overall structure and also comprising ferrite, tempered martensite or tempered bainite and a second phase structure comprising tempered austenite which represents from 3% to 30% by area percentage and also optionally comprising bainite and/or martensite, the residual austenite having a concentration C (C gamma R) of 0.8% or more. This patent application does not make it possible to achieve sufficiently high strength levels necessary to significantly reduce the thicknesses and therefore the weight of the sheets used in the automobile industry, for example.

In addition, US20110198002A1 describes a high-strength and hot-dip coated steel with a mechanical strength greater than 1200 MPa, an elongation greater than 13% and a hole expansion ratio greater than 50% as well as a method for the production of this steel, starting from the following chemical composition: 0.05-0.5% carbon, 0.01-2.5% silicon, 0.5-3.5% manganese, 0.003-0.100% phosphorus, up to 0.02% sulfur, and 0.010-0.5% aluminum, the remainder consisting of impurities. The microstructure of this steel comprises, in terms of area percentages, 0-10% ferrite, 0-10% martensite, and 60-95% tempered martensite and containing, in proportions determined by X-ray diffraction: 5-20% residual austenite. Nevertheless, the ductility levels achieved by the steels according to this invention are low, which has an adverse effect on the shaping of the part starting with the product obtained on the basis of the information contained in this application.

Finally, the publication entitled "Fatigue strength of newly developed high-strength low alloy TRIP-aided steels with good hardenability" presents a study of a steel having the following composition: 0.4% C, 1.5% Si, 1.5% Mn, 0-1.0% Cr, 0-0.2% Mo, 0.05% Nb, 0-18 ppm B for automotive applications. This steel exhibits very good fatigue strength exceeding that of conventional steels. This property is enhanced even further by additions of B, Cr and Mo. The microstructure of this steel has a TRIP effect with a high level of metastable residual austenite that prevents pre-cracks and their propagation on account of the plastic stress relief and the formation of martensite during the transformation from austenite. This article discloses a method for the production of steels that offer an excellent strength-ductility compromise, although the chemical compositions disclosed as well as the production methods are not only not compatible with industrial production but result in coatability problems.

BRIEF SUMMARY OF THE INVENTION

An object of the present invention is to resolve the problems mentioned above. It makes available a cold-rolled steel that has a mechanical strength greater than or equal to 980 MPa, a limit of elasticity greater than or equal to 650 MPa together with a uniform elongation greater than or equal to 15%, an elongation at break greater than or equal to 20% as well as a method for its production. The invention also makes available a steel that can be produced in a stable manner.

The present invention provides a steel sheet, the composition of which comprises, in percent by weight, $0.20\% \leq C \leq 0.40\%$, preferably $0.22\% \leq C$ 0.332%, $0.8\% \leq Mn \leq 1.4\%$, preferably $1.0\% \leq Mn \leq 1.4\%$, $1.60\% \leq Si \leq 3.00\%$, preferably $1.8\% \leq Si \leq 2.5\%$, $0.015 \leq Nb \leq 0.150\%$, preferably $0.020 \leq Nb \leq 0.13\%$, $Al \leq 0.1\%$, $Cr \leq 1.0\%$, preferably $Cr \leq 0.5\%$, $S \leq 0.006\%$, $P \leq 0.030\%$, $Ti \leq 0.05\%$, $V \leq 0.05\%$, $Mo < 0.03\%$, $B \leq 0.003\%$, $N \leq 0.01\%$, the remainder of the composition including iron and unavoidable impurities resulting from processing, the microstructure being constituted, in area percentages, of 10 to 30% residual austenite, from 30 to 60% annealed martensite, from 5 to 30% bainite, from 10 to 30% fresh martensite and less than 10% ferrite.

Preferably, the steel sheet according to the invention comprises a zinc or zinc alloy coating or an aluminum or aluminum alloy coating. These coatings may or may not be alloyed with iron, referred to as galvanized sheet (GI/GA).

Preferably, the sheets according to the invention exhibit a mechanical behavior such that their mechanical strength is greater than or equal to 980 MPa, the yield stress is greater than or equal to 650 MPa, the uniform elongation is greater than or equal to 15% and the elongation at break is greater than or equal to 20%

The present invention further provides a method for the production of a cold-rolled, double-annealed and optionally coated steel sheet comprising the following steps in sequence:

- a steel having the composition according to the invention is obtained
- this steel is cast into a semi-finished product, then this semi-finished product is brought to a temperature $T_{rech}$ between 1100° C. and 1280° C. to obtain a reheated semi-finished product, then
- this reheated semi-finished product is hot rolled, wherein the temperature at the end of the hot rolling $T_{fl}$ is greater than or equal to 900° C. to obtain a hot-rolled sheet, then
- this hot-rolled sheet is coiled at a temperature $T_{bob}$ between 400 and 600° C. to obtain a coiled hot-rolled sheet, then
- this coiled hot-rolled sheet is cooled to ambient temperature, then
- this coiled hot-rolled sheet is uncoiled and pickled, then
- this hot-rolled sheet is cold rolled at a reduction rate between 30 and 80% to obtain a cold-rolled sheet, then,
- this cold-rolled sheet is annealed a first time by heating it at a rate $V_{C1}$ between 2 and 50° C./s to a temperature $T_{soaking1}$ between TS1=910.7−431.4*C−45.6*Mn+54.4*Si−13.5*Cr+52.2*Nb, the contents being expressed in percent by weight, and 950° C., for a length of time $t_{soaking1}$ between 30 and 200 seconds, then:
- this sheet is cooled by cooling it to the ambient temperature at a rate greater than or equal to 30° C./s, then,
- this sheet is annealed a second time by re-heating it at a rate $V_{C2}$ between 2 and 50° C. to a temperature $T_{soaking2}$ between Ac1 and TS=906.5−440.6*C−44.5*Mn+49.2*Si−12.4*Cr+55.9*Nb, for a length of time $t_{soaking2}$ between 30 and 200 seconds, then,
- this sheet is cooled by cooling it at a rate greater than or equal to 30° C./s to an end-of-cooling temperature $T_{OA}$ between 420° C. and 480° C., then,
- this sheet is held in the temperature range of 420 to 480° C. for a length of time $t_{OA}$ between 5 and 120 seconds, then,
- optionally, a coating is applied on this sheet before cooling the sheet to the ambient temperature.

In one preferred embodiment, a basic annealing of this coiled hot-rolled sheet is performed before cold rolling so that the sheet is heated, then held at a temperature between 400° C. and 700° C. for a length of time between 5 and 24 hours.

Preferably, the sheet is held at the end-of-cooling temperature $T_{OA}$ isothermally between 420 and 480° C. for between 5 and 120 seconds.

Preferably, the double annealed, cold-rolled sheet is then cold rolled at a cold rolling rate between 0.1 and 3% before the deposition of a coating.

In one preferred embodiment, the double annealed sheet is finally heated to a hold temperature $T_{base}$ between 150° C. and 190° C. for a hold time $t_{base}$ between 10 h and 48 h.

Preferably, at the end of the hold at $T_{OA}$, the sheet is hot-dip coated in a liquid bath of one of the following elements: Al, Zn, an Al alloy or a Zn alloy.

The double annealed and coated cold-rolled sheet according to the invention or produced by a method according to the invention may be used for the manufacture of parts for motorized land vehicles.

DETAILED DESCRIPTION

Other characteristics and advantages of the invention will become apparent in the following description.

According to the invention, the carbon content by weight is between 0.20 and 0.40%. If the carbon content of the invention is below 0.20% by weight, the mechanical strength becomes insufficient and the residual austenite fraction is still insufficient and not stable enough to achieve a uniform elongation greater than 15%. Above 0.40%, weldability is increasingly reduced because microstructures of low toughness are formed in the Heat Affected Zone (HAZ) or in the molten zone in the case of resistance welding. In one preferred embodiment, the carbon content is between 0.22 and 0.32%. Within this range, the weldability is satisfactory, the stabilization of the austenite is optimized and the fraction of fresh martensite is within the range specified by the invention.

According to the invention, the manganese content is between 0.8 and 1.4%. Manganese is an element that hardens by substitutional solid solution. It stabilizes the austenite and lowers the transformation temperature Ac3. Manganese therefore contributes to an increase of the mechanical strength. According to the invention, a minimum content of 0.8% by weight is necessary to obtain the desired mechanical properties. Nevertheless, beyond 1.4%, its gammagenic character results in a slowdown of the bainitic transformation kinetic that takes place during the hold at the end-of-cooling temperature $T_{OA}$ and the bainite fraction is still insufficient to achieve an elastic strength greater than 650 MPa. Preferably, the manganese content is selected in the range between 1.0% and 1.4%, which combines satisfactory mechanical strength without increasing the risk of reducing the bainite fraction and thereby reducing the yield stress, or increasing hardenability in welded alloys, which would have an adverse effect on the weldability of the sheet according to the invention.

The silicon content must be between 1.6 and 3.0%. In this range, the stabilization of the residual austenite is made possible by the addition of silicon, which significantly slows down the precipitation of carbides during the annealing cycle and more particularly during the bainitic transformation. That results from the fact that the solubility of silicon in cementite is very low and that this element increases the activity of the carbon in the austenite. Any formation of cementite will therefore be preceded by a Si rejection step at the interface. The carbon enrichment of the austenite therefore leads to its stabilization at the ambient temperature on the double annealed and coated steel sheet. Subsequently, the application of an external stress by shaping, for example, will lead to the transformation of this austenite into martensite. The result of this transformation is also to improve resistance to damage. Silicon is also a strong solid solution hardening element and therefore makes it possible to achieve the elastic and mechanical strength levels specified by the invention. With regard to the properties specified by the invention, an addition of silicon in a quantity greater than 3.0% will significantly promote the ferrite and the specified mechanical strength would not be achieved. In addition, strongly adhering oxides would be formed that would result in surface defects and the non-adherence of the zinc or zinc alloy coating. Therefore, the minimum content must be set at 1.6% by weight to obtain the stabilizing effect on the austenite. The silicon content will preferably be between 1.8 and 2.5% to optimize the above-mentioned effects.

The chromium content must be limited to 1.0%. This element makes it possible to control the formation of pro-eutectoid ferrite while cooling during annealing from the above mentioned hold temperature $T_{soaking1}$ or $T_{soaking2}$ because in high quantity this ferrite reduces the mechanical strength necessary for the sheet according to the invention. This element also makes it possible to harden and refine the bainitic microstructure. However, this element significantly slows down the bainitic transformation kinetics. Nevertheless, in levels greater than 1.0% the bainite fraction is still insufficient to achieve a yield stress greater than 650 MPa.

Nickel and copper have effects that are essentially similar to that of manganese. These two elements will be present in trace levels, namely 0.05% for each element, but only because their costs are much higher than that of manganese.

The aluminum content is limited to 0.1% by weight. Aluminum is a powerful alphagenic element that promotes the formation of ferrite. A high aluminum content would raise the Ac3 point and thereby make the industrial process expensive in terms of the energy input required for annealing. It is also thought that high aluminum contents increase the erosion of refractories and the risk of plugged nozzles during the casting of the steel upstream of the rolling. Aluminum also segregates negatively and it can lead to macro-segregations. In excessive quantities, aluminum reduces hot ductility and increases the risk of the appearance of defects in continuous casting. Without a close control of the casting conditions, micro- and macro-segregation defects ultimately result in a central segregation on the annealed steel sheet. This central band will be harder than its surrounding matrix and will have an adverse effect on the formability of the materials.

The sulfur content must be less than 0.006%. Above that, the ductility is reduced on account of the excessive presence of sulfides such as MnS, also called manganese sulfides, which reduce the suitability for deformation.

The phosphorus content must be less than 0.030%. Phosphorus is an element that hardens in solid solution but significantly reduces suitability for spot welding and hot ductility, particularly on account of its tendency to segregate at the grain boundaries or its tendency toward co-segregation with manganese. For these reasons, its content must be limited to 0.030% to achieve proper suitability for spot welding.

The niobium content must be between 0.015 and 0.150%. Niobium is a micro-alloy element that has the special property of forming precipitates that harden with carbon and/or nitrogen. These precipitates, which are already present at the time of the hot rolling operation, delay recrystallization during annealing and therefore refine the microstructure, which allows it to contribute to the hardening of the material. It also makes it possible to improve the elongation properties of the product by making possible high-temperature annealings without reducing the elongation performance by a refining effect on the structures. The niobium content must nevertheless be limited to 0.150% to avoid excessively high hot rolling forces. In addition, above 0.150%, a saturating effect is reached with regard to the positive effects of niobium, in particular with regard to the hardening effect by refinement of the microstructure. On the other hand, the niobium content must be greater than or equal to 0.015%, which makes it possible to have a hardening of the ferrite when it is present and such a hardening is desirable, as well as sufficient refinement for greater stabilization of the residual austenite, and also to guarantee a uniform elongation as specified by the invention, the Nb content is preferably between 0.020 and 0.13 to optimize the above-mentioned effects.

The other micro alloy elements such as titanium and vanadium are limited to a maximum level of 0.05% because these elements have the same benefits as niobium although they have the particular feature that they more strongly reduce the ductility of the product.

The nitrogen content is limited to 0.01% to prevent aging phenomena of the material and to minimize the precipitation of aluminum nitrides (AlN) during the solidification and therefore the embrittlement of the semi-finished product.

Boron and molybdenum are at the level of impurities, i.e. levels individually less than 0.003 for boron and 0.03 for molybdenum.

The remainder of the composition consists of iron and unavoidable impurities resulting from processing.

According to the invention, the microstructure of the steel after the first annealing must contain, in area percentage, less than 10% polygonal ferrite, with the remainder of the microstructure composed of fresh or tempered martensite. If the polygonal ferrite content is greater than 10%, the mechanical strength and the yield stress of the steel after the second annealing will be less than 980 MPa and 650 MPa respectively. In addition, a polygonal ferrite content greater than 10% at the conclusion of the first annealing will result in a polygonal ferrite content at the conclusion of the second annealing greater than 10%, which would result in a yield stress and mechanical strength that are too low in relation to the specifications of the invention.

The microstructure of the steel after the second annealing must contain, in area percentage, from 10 to 30% residual austenite. If the residual austenite content is less than 10%, the uniform elongation will be less than 15% because the residual austenite will be too stable and cannot be transformed into martensite under mechanical stresses that lead to a significant gain in the work hardening of the steel, de facto delaying the appearance of necking which translates into an increase in the uniform elongation. If the residual austenite content is greater than 30%, the residual austenite will be unstable because it is insufficiently enriched in carbon during the second annealing and the hold at the end-of-cooling temperature $T_{OA}$ and the ductility of the steel after the second annealing will be reduced, which will result in a uniform elongation of less than 15% and/or a total elongation of less than 20%.

In addition, the steel according to the invention, after the second annealing, must contain, in area percentage, from 30 to 60% annealed martensite, which is a martensite resulting from the first annealing, annealed during the second annealing and which is distinguished from fresh martensite by a lower quantity of crystallographic defects, and which is distinguished from a tempered martensite by the absence of carbides in its lattice. If the annealed martensite content is less than 30%, the ductility of the steel will be too low because the residual austenite content will be too low because it is insufficiently enriched in carbon and the level of fresh martensite will be too high, which leads to a uniform elongation of less than 15%. If the annealed martensite content is greater than 60%, the ductility of the steel will be too low because the residual austenite will be too stable and cannot be transformed into martensite under the effect of mechanical stresses, the effect of which will be to reduce the ductility of the steel according to the invention and will result in a uniform elongation less than 15% and/or a total elongation less than 20%.

Still according to the invention, the microstructure of the steel after the second annealing must contain, in area percentage, from 5 to 30% bainite. The presence of bainite in the microstructure is justified by the role it plays in the carbon enrichment of the residual austenite. During the bainitic transformation and thanks to the presence of large quantities of silicon, the carbon is redistributed from the bainite to the austenite, the effect of which is to stabilize the latter at ambient temperature. If the bainite content is less than 5%, the residual austenite will not be sufficiently enriched in carbon and will not be sufficiently stable, which will promote the presence of fresh martensite, which will result in a significant reduction in ductility. The uniform elongation will then be less than 15%. If the bainite content is greater than 30%, it will lead to an excessively stable residual austenite that cannot be transformed into martensite under the effect of mechanical stresses, the effect of which will be a uniform elongation less than 15% and/or a total elongation less than 20%.

Finally, the steel according to the invention and after the second annealing must contain, in area percentages, from 10 to 30% fresh martensite. If the content of fresh martensite is less than 10%, the mechanical strength of the steel will be less than 980 MPa. If it is greater than 30%, the residual austenite content will be too low, the steel will not be sufficiently ductile and the uniform elongation will be less than 15%.

The sheet according to the invention can be produced by any suitable method.

The first step is to procure a steel having a composition according to the invention. Then a semi-finished product is cast from this steel. The steel can be cast in ingots or continuously in the form of slabs.

The reheat temperature must be between 1100 and 1280° C. The cast semi-finished products must to be brought to a temperature $T_{rech}$ greater than 1100° C. to obtain a reheated semi-finished product to achieve at all points a temperature favorable to the high deformations the steel will experience during rolling. This temperature range also makes it possible to be in the austenitic range and to ensure the complete dissolution of the precipitates resulting from casting. Nevertheless, if the temperature $T_{rech}$ is greater than 1280° C., the austenite grains grow undesirably and lead to a coarser final structure and the risks of surface defects linked to the presence of liquid oxide are increased. It is of course also possible to hot roll the steel immediately after casting without reheating the slab.

The semi-finished product is then hot rolled in a temperature range in which the structure of the steel is totally austenitic. If the end-of-rolling temperature $T_{fl}$ is less than 900° C., the rolling forces are very high and can require a great deal of energy or can even break the rolling mill. Preferably, an end-of-rolling temperature greater than 950° C. will be respected to guarantee that rolling takes place in the austenitic range and therefore to limit the rolling forces.

The hot rolled product will then be coiled at a temperature $T_{bob}$ between 400 and 600° C. This temperature range makes it possible to obtain ferritic, bainitic or perlitic transformations during the quasi-isothermal hold associated with the coiling followed by a slow cooling to minimize the martensite fraction after cooling. A coiling temperature greater than 600° C. leads to the formation of undesirable surface oxides. When the coiling temperature is too low, below 400° C., the hardness of the product after cooling is increased, which increases the force required during the subsequent cold rolling.

The hot-rolled product is then pickled if necessary according to a method that is itself known.

Optionally, an intermediate batch annealing of the coiled hot rolled sheet will be carried out between $T_{RB1}$ and $T_{RB2}$ where $T_{RB1}$=400° C. and $T_{RB2}$=700° C. for a length of time between 5 and 24 hours. This heat treatment makes it possible to have a mechanical strength below 1000 MPa at every point in the hot rolled sheet, thereby minimizing the difference in hardness between the center of the sheet and the edges. This significantly facilitates the following cold rolling step by softening the structure formed.

A cold rolling is then performed with a reduction range preferably between 30 and 80%.

The first annealing of the cold rolled product is then carried out, preferably in a continuous annealing line, at an average heating rate $V_C$ between 2 and 50° C. per second. In relation to the annealing temperature $T_{soaking1}$, this heating rate range makes it possible to obtain a recrystallization and adequate refining of the structure. Below 2° C. per second, the risks of surface decarburization increase significantly. Above 50° C. per second, traces of non-recrystallization and insoluble carbides will appear during the soaking, the results of which will be a reduction in the residual austenite fraction and which will have an undesirable effect on the ductility.

The heating is carried out to an annealing temperature $T_{soaking1}$ between the temperature TS1 and 950° C., where TS1=910.7−431.4*C−45.6*Mn+54.4*Si−13.5*Cr+52.2*Nb with temperatures in ° C. and chemical compositions in percent by weight, when $T_{soaking1}$ is less than TS1, the presence of polygonal ferrite is promoted above 10% and therefore beyond the range specified by the invention. Conversely, if $T_{soaking1}$ is above 950° C., the austenite grain sizes increase significantly, which has an undesirable effect on the refining of the final microstructure and therefore on the levels of the limit of elasticity that will be below 650 MPa.

A hold time $t_{soaking1}$ between 30 and 200 seconds at the temperature $T_{soaking1}$ makes possible the dissolution of the previously formed carbides, and in particular a sufficient transformation into austenite. Below 30 seconds, the dissolution of the carbides would be insufficient. In addition, a hold time greater than 200 seconds is difficult to reconcile with the productivity requirements of continuous annealing lines, in particular with the speed of advance of the coil. In addition, the same risk of coarsening of the austenite grain as in the case of $T_{soaking1}$ above 950° C. appears, with the same risk of having a limit of elasticity less than 650 MPa. The hold time $t_{soaking1}$ is therefore between 30 and 200 seconds.

At the end of the hold of the first annealing, the sheet is cooled to the ambient temperature, wherein the cooling rate $V_{refl}$ is fast enough to prevent the formation of ferrite. For this purpose, this cooling rate is greater than 30° C. per second, which makes it possible to obtain a microstructure with less than 10% ferrite, the remainder being martensite. Preferably, priority will be given to an entirely martensitic microstructure at the conclusion of the first annealing.

The second annealing of the cold rolled product that has already been annealed once is then performed, preferably in a continuous galvanizing annealing line, at an average heating rate $V_C$ greater than 2° C. per second to avoid the risk of surface decarburization. Preferably, the average heating rate must be less than 50° C. per second to prevent the presence of insoluble carbides during the hold, which would have the effect of reducing the residual austenite fraction.

The steel is heated to an annealing temperature $T_{soaking2}$ between the temperature Ac1=728−23.3*C−40.5*Mn+26.9*Si+3.3*Cr+13.8*Nb and TS2=906.5-440.6*C−

44.5*Mn+49.2*Si−12.4*Cr+55.9*Nb with the temperatures in ° C. and the chemical compositions in percent by weight. When $T_{soaking2}$ is less than Ac1, it is not possible to obtain the microstructure specified by the invention because only the tempering of the martensite resulting from the first annealing would take place. When $T_{soaking2}$ is greater than TS2, the annealed martensite content will be less than 30%, which will promote the presence of a large quantity of fresh martensite, which severely degrades the ductility of the product.

A hold time $t_{soaking2}$ between 30 and 200 seconds at the temperature $T_{soaking2}$ makes possible the dissolution of the carbides previously formed, and in particular a sufficient transformation to austenite. Below 30 seconds, the dissolution of the carbides can be insufficient. In addition, a hold time greater than 200 seconds is difficult to reconcile with the productivity requirements of continuous annealing lines, in particular the speed of advance of the coil. In addition, the same risk of coarsening of the austenite grain as in the case of $t_{soaking1}$ would appear above 200 seconds, with the same risk of having a limit of elasticity below 650 MPa. The hold time $t_{soaking2}$ is therefore between 30 and 200 seconds.

At the end of the hold in the second annealing, the sheet is cooled until it reaches an end-of-cooling temperature $T_{OA}$ between $T_{OA1}$=420° C. and $T_{OA2}$=480° C., wherein the cooling rate $V_{ref2}$ is fast enough to prevent the massive formation of ferrite, i.e., a content greater than 10%, for this purpose, this cooling rate is greater than 20° C. per second.

The end-of-cooling temperature must be between $T_{OA1}$=420° C. and $T_{OA2}$=480° C. Below 420° C., the bainite formed will be hard, which risks having an adverse effect on the ductility, which can be less than 15% for uniform elongation. In addition, this temperature is too low if the sheet is to be run through a zinc bath, the temperature of which is generally at 460° C. and would result in a continuous cooling of the bath. If the temperature $T_{OA}$ is above 480° C., there is a risk of precipitating the cementite, a carburized phase that will reduce the carbon available to stabilize the austenite. Moreover, in the case of hot dip galvanization, there is a risk of evaporating the liquid Zn while losing control of the reaction between the bath and the steel if the temperature is too high, i.e., above 480° C.

The hold time $t_{OA}$ in the temperature range $T_{OA1}$ (° C.) to $T_{OA2}$ (° C.) must be between 5 and 120 seconds to permit the bainitic transformation and thus the stabilization of the austenite by carbon enrichment of this austenite. It must also be greater than 5 seconds to guarantee a bainite content in accordance with the invention otherwise the limit of elasticity would fall below 650 MPa. It must also be less than 120 seconds to limit the bainite content to 30% as specified in the invention otherwise the residual austenite content would be less than 10% and the ductility of the steel would be too low, which would be manifested by a uniform elongation less than 15% and/or a total elongation less than 20%.

At the end of this hold between $T_{OA1}$ (° C.) and $T_{OA2}$ (° C.), the double annealed sheet is coated with a deposit of zinc or zinc alloy (in which Zn represents the majority element in percent by weight) by hot dip coating before cooling to the ambient temperature. Preferably, the zinc or zinc alloy coating can be applied by any electrolytic or physico-chemical method known in itself on the bare annealed sheet. A base coating of aluminum or aluminum alloy (in which Al represents the majority element in percent by weight) can also be deposited by hot-dip coating.

Preferably, a post batch annealing heat treatment on the cold rolled and double annealed and coated sheet is then performed at a hold temperature $T_{base}$ between 150° C. and 190° C. for a hold time $t_{base}$ between 10 and 48 hours to improve the yield stress and bendability. This treatment is called a post batch annealing.

The present invention is illustrated below on the basis of nonrestrictive examples.

Examples

Steels having the composition presented in the table below, expressed in percent by weight, were prepared. Table 1 indicates the chemical composition of the steel that was used for the fabrication of the sheets in the examples.

TABLE 1 chemical composition (percent by weight) and critical temperatures, Ae1, TS1 and TS2 in ° C.

| Acier | C | Mn | Si | Al | Cr | Mo | Cu | Ni | V | Nb | S | P | B | Ti | N | Ae1 | TS1 | TS2 |
|---|---|---|---|---|---|---|---|---|---|---|---|---|---|---|---|---|---|---|
| A | 0.26 | 1.3 | 2.12 | 0.027 | 0.002 | 0.002 | 0.005 | 0.006 | 0.002 | 0.124 | 0.0027 | 0.019 | 0.0005 | 0.004 | 0.002 | 728 | 862 | 846 |
| B | 0.28 | 1.17 | 1.99 | 0.03 | 0.003 | 0.003 | 0.007 | 0.008 | 0.003 | 0.017 | 0.0036 | 0.014 | 0.00042 | 0.007 | 0.0014 | 727 | 844 | 829 |
| C | 0.29 | 1.17 | 1.98 | 0.029 | 0.003 | 0.003 | 0.007 | 0.008 | 0.003 | 0.068 | 0.0036 | 0.014 | 0.0004 | 0.006 | 0.0016 | 728 | 845 | 830 |
| D | 0.21 | 1.25 | 3.04 | 0.023 | 0.004 | 0.005 | 0.005 | 0.004 | 0.002 | 0.00 | 0.0033 | 0.018 | 0.0006 | 0.004 | 0.0015 | 754 | 927 | 907 |
| E | 0.19 | 1.68 | 1.55 | 0.053 | 0.024 | 0.006 | 0.007 | 0.017 | 0.004 | 0.001 | 0.002 | 0.009 | 0.0007 | 0.003 | 0.004 | 697 | 836 | 824 |

Acier = Steel

The references D and E in table 1 identify steels, the compositions of which are not as specified by the invention. The contents not in conformance with the invention are underlined.

It will be noted in particular that the references D and E are not in conformance with the invention because their compositions contain niobium, which will limit the yield stress and mechanical strength of the final sheet on account of the absence of precipitation hardening.

It will also be noted that references D and E are not in conformance with the invention because their silicon content is outside the specified range. A silicon content above 3.00% will promote an excessive quantity of ferrite and the specified mechanical strength will not be achieved. Below 1.60% by weight, the stabilization of the residual austenite will be insufficient to obtain the desired ductility.

It will further be noted that reference D is not in conformance with the invention because the carbon content is less than that specified, which will limit the final strength and the ductility of the sheet. Moreover, the manganese content is too high, which will limit the final quantity of bainite in the sheet, the effect of which will be to limit the ductility of the sheet as a result of the presence of an excessive quantity of fresh martensite.

Sheets corresponding to the above compositions were produced under the fabrication conditions presented in table 2.

Starting with these compositions, certain steels were subjected to different annealing conditions. The conditions before hot rolling were identical, with a reheating between 1200° C. and 1250° C., an end-of-rolling temperature between 930° C. and 990° C. and coiling between 540° C. and 560° C. The hot rolled products were then all pickled and then immediately cold rolled with a reduction rate between 50 and 70%.

Table 2 also shows the fabrication conditions of the annealed sheets after cold rolling, with the following designations:

reheating temperature: $T_{rech}$
end-of-rolling temperature: $T_{fl}$
coiling temperature: $T_{BOB}$
cold-rolling reduction rate
heating rate during first annealing: $V_{C1}$
hold temperature during the first annealing: $T_{soaking1}$
hold time during the first annealing at $T_{soaking1}$: $t_{soaking1}$
cooling rate during the first annealing: $V_{ref1}$
cooling rate during the second annealing: $V_{C2}$
hold temperature during the second annealing: $T_{soaking2}$
hold time during the second annealing at $T_{soaking1}$: $t_{soaking2}$
cooling rate during the second annealing: $V_{ref2}$
end-of-cooling temperature $T_{OA}$
hold time at the temperature $T_{OA}$: $t_{OA}$
the calculated temperatures Ac1, TS1 and TS2 (in ° C.)

TABLE 2

Annealing conditions of the examples and references

| Acier | ID | $T_{rech}$ (° C.) | $T_{fl}$ (° C.) | $T_{BOB}$ (° C.) | Taux de réduction (%) | $V_{C1}$ (° C./s) | $T_{Soaking1}$ (° C.) | $t_{Soaking1}$ (s) | $V_{ref1}$ (° C./s) | $V_{C2}$ (° C./s) |
|---|---|---|---|---|---|---|---|---|---|---|
| A | A_1 | 1240 | 963 | 551 | 62 | 15 | 900 | 120 | 800 | 15 |
| A | A_2 | 1240 | 963 | 551 | 62 | 15 | 900 | 120 | 800 | 15 |
| A | A_3 | 1240 | 963 | 551 | 62 | 15 | 900 | 120 | 800 | 15 |
| A | A_4 | 1240 | 963 | 551 | 62 | 15 | 900 | 120 | 800 | 15 |
| A | A_5 | 1240 | 963 | 551 | 62 | 15 | 800 | 120 | 800 | 15 |
| A | A_6 | 1240 | 963 | 551 | 62 | 15 | 800 | 120 | 800 | 15 |
| B | B_1 | 1245 | 951 | 546 | 59 | 15 | 900 | 120 | 800 | 15 |
| B | B_2 | 1245 | 951 | 546 | 59 | 15 | 840 | 120 | 800 | 15 |
| B | B_3 | 1245 | 951 | 546 | 59 | 15 | 840 | 120 | 800 | 15 |
| B | B_4 | 1245 | 951 | 546 | 59 | 15 | 840 | 120 | 800 | 15 |
| C | C_1 | 1245 | 951 | 546 | 59 | 15 | 900 | 120 | 800 | 15 |
| C | C_2 | 1245 | 951 | 546 | 59 | 15 | 840 | 120 | 800 | 15 |
| C | C_3 | 1245 | 951 | 546 | 59 | 15 | 840 | 120 | 800 | 15 |
| C | C_4 | 1245 | 951 | 546 | 59 | 15 | 840 | 120 | 800 | 15 |
| C | C_5 | 1245 | 951 | 546 | 59 | — | — | — | — | 15 |
| D | D_1 | 1243 | 965 | 553 | 61.5 | 15 | 850 | 120 | 800 | 15 |
| D | D_2 | 1243 | 965 | 553 | 61.5 | 15 | 850 | 120 | 800 | 15 |
| E | E_1 | 1210 | 952 | 541 | 52 | 15 | 870 | 120 | 800 | 5 |
| E | E_2 | 1210 | 952 | 541 | 52 | 15 | 870 | 120 | 800 | 5 |
| E | E_3 | 1210 | 952 | 541 | 52 | 15 | 870 | 120 | 800 | 5 |
| E | E_4 | 1210 | 952 | 541 | 52 | 15 | 870 | 120 | 800 | 5 |
| E | E_5 | 1210 | 952 | 541 | 52 | 15 | 870 | 120 | 800 | 3 |
| E | E_6 | 1210 | 952 | 541 | 52 | 15 | 870 | 120 | 800 | 3 |

| Acier | ID | $T_{Soaking2}$ (° C.) | $t_{Soaking2}$ (s) | $V_{ref2}$ (° C./s) | $T_{OA}$ (° C.) | $t_{OA}$ (s) | Ac1 | TS1 | TS2 |
|---|---|---|---|---|---|---|---|---|---|
| A | A_1 | 770 | 120 | 95 | 460 | 15 | 728 | 862 | 847 |
| A | A_2 | 770 | 120 | 95 | 460 | 20 | 728 | 862 | 847 |
| A | A_3 | 770 | 120 | 95 | 450 | 25 | 728 | 862 | 847 |
| A | A_4 | 770 | 120 | 95 | 450 | 30 | 728 | 862 | 847 |
| A | A_5 | 770 | 120 | 95 | 460 | 15 | 728 | 862 | 847 |
| A | A_6 | 770 | 120 | 95 | 460 | 20 | 728 | 862 | 847 |
| B | B_1 | 750 | 120 | 95 | 400 | 15 | 728 | 845 | 829 |
| B | B_2 | 750 | 120 | 95 | 450 | 30 | 728 | 845 | 829 |
| B | B_3 | 770 | 120 | 95 | 450 | 30 | 728 | 845 | 829 |
| B | B_4 | 790 | 120 | 95 | 450 | 30 | 728 | 845 | 829 |
| C | C_1 | 750 | 120 | 95 | 450 | 15 | 728 | 846 | 830 |
| C | C_2 | 750 | 120 | 95 | 450 | 30 | 728 | 846 | 830 |
| C | C_3 | 770 | 120 | 95 | 450 | 30 | 728 | 846 | 830 |
| C | C_4 | 790 | 120 | 95 | 450 | 30 | 728 | 846 | 830 |
| C | C_5 | 770 | 120 | 95 | 450 | 30 | 728 | 846 | 830 |
| D | D_1 | 800 | 120 | 95 | 460 | 30 | 754 | 927 | 907 |
| D | D_2 | 800 | 120 | 95 | 460 | 30 | 754 | 927 | 907 |
| E | E_1 | 820 | 87 | 36 | 450 | 25 | 697 | 837 | 825 |
| E | E_2 | 840 | 87 | 36 | 450 | 25 | 697 | 837 | 825 |
| E | E_3 | 850 | 87 | 36 | 450 | 25 | 697 | 837 | 825 |
| E | E_4 | 860 | 87 | 36 | 450 | 25 | 697 | 837 | 825 |
| E | E_5 | 800 | 110 | 23 | 450 | 38 | 697 | 837 | 825 |
| E | E_6 | 820 | 110 | 24 | 450 | 38 | 697 | 837 | 825 |

Acier = Steel,
Taux de réduction = Reduction rate

The references A5 to A6, B1 to B4, C2 to C5, D1 and D2, E1 to E6 in table 2 designate the steel produced under conditions not in conformance with the invention on the basis of steels having the compositions indicated in table 1. The parameters not in conformance with the invention are underlined.

It should be noted that the references A5, A6, B2 to B4, C2 to C4, D1 and D2 are not in conformance with the invention because the hold temperature in the first annealing $T_{soaking1}$ is less than the calculated temperature TS1, which would promote a large quantity of ferrite in the first annealing, thereby limiting the mechanical strength of the sheet after the second annealing.

It should also be noted that references E2, E3 and E4 are not in conformance with the invention on account of their chemical composition and the fact that the hold temperature in the second annealing $T_{soaking2}$ is greater than the calculated temperature TS2, which will have the effect of reducing the quantity of annealed martensite after the second annealing, limiting the final ductility of the sheet on account of an excessive quantity of fresh martensite.

It should also be noted that reference B1 is not in conformance with the invention because the temperature $T_{OA}$ is outside the range 420° C.-480° C., which will limit the quantity of residual austenite after the second annealing and will therefore limit the ductility of the sheet.

It should also be noted that reference C5 is not in conformance with the invention because only a single annealing in conformance with the invention and the claims of the second annealing has been carried out on the sheet. The lack of the first annealing results in the absence of annealed martensite in the microstructure, which seriously limits the final yield stress and mechanical strength of the sheet.

Finally, it will be noted that the two references E5 and E6 are not in conformance with the invention, the cooling rate in the second annealing $V_{Ref2}$ is less than 30° C. per second, which promotes the formation of ferrite during cooling, which will have the effect of reducing the limit of elasticity and the mechanical strength of the sheet.

The examples A1 to A4, C1 are those according to the invention.

The mechanical properties are then measured using an ISO 12.5×50 test piece and the contents of each of the phases present in the microstructures prepared by taking a cross-section of the material on the basis of the chemical compositions indicated in table 1 are analyzed on the basis of the methods described in table 2. Uni-axial tensile tests were performed to obtain these mechanical properties in the direction parallel to that of the cold rolling.

The contents of each of the phases after each annealing and the mechanical tensile strength properties obtained have been entered in table 3 below, with the following abbreviations:

% M1: area percentage of martensite after the first annealing
% F1: area percentage of ferrite after the first annealing
% M2: area percentage of martensite after the second annealing
% F2: area percentage of ferrite after the second annealing
% RA: area percentage of residual austenite after the second annealing
% AM: area percentage of annealed martensite after the second annealing
% B: area percentage of bainite after the second annealing
yield stress: Re
mechanical strength: Rm
uniform elongation: Al. Unif.
total elongation: Al. Total.

TABLE 3

Area percentages of each of the phases of the microstructures and mechanical properties of the references and the invention.

| Acier | ID | % M1 | % F1 | % M2 | % F2 | % RA | % AM | % B | Re (MPa) | Rm (MPa) | Al. Unif. (%) | Al. Total. (%) | Re/Rm |
|---|---|---|---|---|---|---|---|---|---|---|---|---|---|
| A | A_1 | 97 | 3 | 22 | 3 | 17 | 48 | 10 | 667 | 1000 | 20.6 | 24.1 | 0.67 |
| A | A_2 | 96 | 4 | 21 | 4 | 18 | 45 | 12 | 723 | 992 | 17.3 | 24.3 | 0.73 |
| A | A_3 | 97 | 3 | 17 | 3 | 19 | 46 | 15 | 671 | 984 | 22.3 | 28.3 | 0.68 |
| A | A_4 | 98 | 2 | 15 | 2 | 21 | 45 | 17 | 684 | 986 | 21.5 | 26.7 | 0.69 |
| A | A_5 | 59 | 41 | 22 | 41 | 17 | 11 | 9 | 496 | 1018 | 20.1 | 21.7 | 0.49 |
| A | A_6 | 60 | 40 | 20 | 40 | 19 | 10 | 11 | 511 | 1007 | 21.5 | 23.3 | 0.51 |
| B | B_1 | 98 | 2 | 6 | 2 | 14 | 56 | 22 | 634 | 881 | 16.8 | 20.5 | 0.72 |
| B | B_2 | 86 | 14 | 8 | 14 | 16 | 48 | 14 | 682 | 925 | 24.7 | 30.7 | 0.74 |
| B | B_3 | 85 | 15 | 13 | 15 | 19 | 41 | 12 | 662 | 926 | 23.8 | 29.4 | 0.71 |
| B | B_4 | 84 | 16 | 18 | 16 | 19 | 36 | 11 | 679 | 917 | 25.8 | 31.3 | 0.74 |
| C | C_1 | 97 | 3 | 14 | 3 | 18 | 53 | 12 | 694 | 981 | 23.2 | 29.0 | 0.71 |
| C | C_2 | 83 | 17 | 6 | 17 | 17 | 45 | 15 | 714 | 905 | 13.7 | 16.6 | 0.79 |
| C | C_3 | 81 | 19 | 10 | 19 | 19 | 38 | 14 | 703 | 928 | 24.0 | 29.4 | 0.76 |
| C | C_4 | 81 | 19 | 19 | 19 | 16 | 33 | 13 | 692 | 916 | 21.4 | 26.5 | 0.76 |
| C | C_5 | — | — | 25 | 48 | 15 | — | 12 | 469 | 850 | 17.4 | 22.2 | 0.55 |
| D | D_1 | 64 | 36 | 17 | 36 | 15 | 26 | 6 | 488 | 999 | 16.6 | 22.0 | 0.49 |
| D | D_2 | 63 | 37 | 18 | 37 | 14 | 22 | 9 | 500 | 1039 | 17.3 | 19.9 | 0.48 |
| E | E_1 | 98 | 2 | 8 | 14 | 21 | 31 | 26 | 600 | 893 | 16 | 20.6 | 0.67 |
| E | E_2 | 97 | 3 | 17 | 16 | 18 | 15 | 34 | 550 | 899 | 18.8 | 23.5 | 0.61 |
| E | E_3 | 98 | 2 | 19 | 17 | 16 | 8 | 40 | 551 | 904 | 18.9 | 23.6 | 0.61 |
| E | E_4 | 96 | 4 | 15 | 19 | 15 | 3 | 48 | 483 | 872 | 19.7 | 25 | 0.55 |
| E | E_5 | 98 | 2 | 13 | 21 | 14 | 43 | 9 | 472 | 925 | 16.9 | 20.5 | 0.51 |
| E | E_6 | 99 | 1 | 19 | 19 | 16 | 32 | 14 | 545 | 897 | 16.3 | 20.1 | 0.61 |

acier = steel

The references A5 and A6, B1 to B4, C2 to C5, D1 and D2, E1 to E6 in table 3 designate the steels produced under the conditions described in table 2 from steels having the compositions indicated in table 1. The mechanical properties and the fractions of phases not in conformance with the invention are underlined.

Examples A1 to A4 and C1 are those according to the invention.

It should be noted that the references A5, A6, D1 and D2 are not in conformance with the invention because the yield stress is less than 650 MPa, which is explained by a large quantity of ferrite at the conclusion of the first annealing and a low fraction of annealed martensite at the conclusion of the second annealing, which is due to a hold temperature $T_{soaking1}$ that is less than the calculated temperature TS1.

It should also be noted that the references B2 to B4 and C2 to C4 are not in conformance with the invention because the mechanical strength is less than 980 MPa, which is explained by a quantity of ferrite greater than 10% after the first annealing, which will limit the fraction of fresh martensite at the conclusion of the second annealing, which is due to a hold temperature $T_{soaking1}$ below the calculated temperature TS1.

It should also be noted that the reference B1 is not in conformance with the invention because the yield stress is less than 650 MPa and the mechanical strength is less than 980 MPa, which is explained by too low a quantity of fresh martensite at the conclusion of the second annealing, which is due to an end-of-rolling temperature $T_{OA}$ below 420° C.

It should also be noted that the references E1 to E6 are not in conformance with the invention because the yield stress is less than 650 MPa and the mechanical strength is less than 980 MPa. The non-conformance of these examples is the result of an unsuitable chemical composition, specifically too low levels of hardening elements (carbon, silicon) and the lack of precipitation hardening due to the absence of niobium. This effect is even more marked for references E2 to E6 because the method taught by the invention has not been respected and the quantities of phases obtained are outside the specified ranges.

Finally, it should be noted that reference C5 is not in conformance with the invention because only a single annealing corresponding to the method of the second annealing taught by the invention has been applied, which results in the absence of the annealed martensite necessary to achieve the yield stress and the mechanical strength specified by the invention.

The invention also makes available a steel sheet suitable for applying a coating of zinc or zinc alloy, in particular using a hot-dip coating process in a liquid zinc bath followed by an alloying heat treatment.

The invention finally makes available a steel that exhibits good weldability in conventional assembly methods such as resistance spot welding, to cite only one non-restricting example.

The steel sheets according to the invention can be used advantageously for the fabrication of structural parts, reinforcing and safety components, anti-abrasives or transmission discs for motorized land vehicles.

The invention claimed is:

1. A steel sheet having a composition comprising, expressed in percent by weight:

0.20%≤C≤0.40%
0.8%≤Mn≤1.4%
1.60%≤Si≤3.00%
0.015≤Nb≤0.150%
Al≤0.1%
Cr≤1.0%
S≤0.006%
P≤0.030%
Ti≤0.05%
V≤0.05%
Mo≤0.03%
B≤0.003%
N≤0.01% a remainder of the composition including iron and unavoidable impurities resulting from processing, and a microstructure including, in area percentage, of 10 to 30% residual austenite, 30 to 60% annealed martensite, 5 to 30% bainite, 10 to 30% fresh martensite and less than 10% ferrite.

2. The steel sheet according to claim 1, wherein the composition includes, expressed in percent by weight: 0.22%≤C≤0.32%.

3. The steel sheet according to claim 1, wherein the composition includes, expressed in percent by weight: 1.0%≤Mn≤1.4%.

4. The steel sheet according to claim 1, wherein the composition includes, expressed in percent by weight: 1.8%≤Si≤2.5%.

5. The steel sheet according to claim 1, wherein the composition includes, expressed in percent by weight: Cr≤0.5%.

6. The steel sheet according to claim 1, wherein the composition includes, expressed in percent by weight:

0.020%≤Nb≤0.13%.

7. The steel sheet according to claim 1, further comprising a coating of zinc or zinc alloy.

8. The steel sheet according to claim 1, further comprising a coating of aluminum or aluminum alloy.

9. The steel sheet according to claim 1, further comprising a mechanical strength greater than or equal to 980 MPa, a yield stress greater than or equal to 650 MPa, a uniform elongation greater than or equal to 15% and an elongation at failure greater than or equal to 20%.

10. Production method for a double-annealed cold-rolled steel sheet, comprising the following steps in sequence:

obtaining a steel having a composition comprising, expressed in percent by weight:

0.20%≤C≤0.40%
0.8%≤Mn≤1.4%
1.60%≤Si≤3.00%
0.015≤Nb≤0.150%
Al≤0.1%
Cr≤1.0%
S≤0.006%
P≤0.030%
Ti≤0.05%
V≤0.05%
Mo≤0.03%
B≤0.003%
N≤0.01% a remainder of the composition including iron and unavoidable impurities resulting from processing; then casting the steel into a semi-finished product; then bringing a temperature of the semi-finished product to a temperature $T_{rech}$ between 1100° C. and 1280° C. to obtain a reheated semi-finished product; then hot rolling the reheated semi-finished product, a temperature at the end of the hot rolling $T_{fl}$ being greater than or equal to 900° C. to obtain a hot-rolled sheet; then coiling the hot-rolled sheet at a temperature $T_{bob}$ between 400 and 600° C. to obtain a coiled hot-rolled sheet; then cooling the coiled hot-rolled sheet to ambient temperature; then uncoiling and pickling the coiled hot-rolled sheet; then cold rolling the hot-rolled sheet at a reduction rate between 30 and 80% to obtain a cold-rolled sheet; then annealing the cold-rolled sheet a first time by heating at a rate $V_{C1}$ between 2 and 50° C./s to a temperature $T_{soaking1}$ between TS1=910.7−431.4*C−45.6*Mn+54.4*Si−13.5*Cr+52.2*Nb, contents being expressed in percent by weight, and 950° C., for a length of time $t_{soaking1}$ between 30 and 200 seconds; then:

cooling the sheet by cooling to ambient temperature at a rate greater than or equal to 30° C./s, then annealing the sheet a second time by re-heating at a rate $V_{C2}$ between 2 and 50° C./s to a temperature $T_{soaking2}$ between Ac1 and TS2=906.5−440.6*C−44.5*Mn+49.2*Si−12.4*Cr+55.9*Nb, the contents being expressed in percent by weight, for a length of time $t_{soaking2}$ between 30 and 200 seconds; then cooling the sheet by cooling at a rate greater than or equal to 30° C./s to an end-of-cooling temperature TOA between 420° C. and 480° C., then holding the sheet in the temperature range of 420° C. to 480° C. for a length of time $t_{OA}$ between 5 and 120 seconds; then optionally, applying a coating on this cold-rolled and annealed sheet; and cooling the sheet to the ambient temperature so as to obtain the steel sheet according to claim 1.

11. Production method according to claim 10, further comprising, before the cold rolling step, a step of:

batch annealing the coiled hot rolled sheet so that the sheet is heated and then held at a temperature between 400° C. and 700° C. for a length of time between 5 and 24 hours.

12. Production method according to claim 10, wherein the sheet is held at the end-of-cooling temperature TOA isothermally between 420 and 480° C. for between 5 and 120 seconds.

13. Production method according to claim 10, further comprising, after the second annealing step, a step of:

cold rolling the double-annealed cold-rolled sheet with a cold rolling rate between 0.1 and 3% before deposition of a coating.

14. Production method according to claim 10, further comprising the step of:

finally heating the sheet to a hold temperature $T_{base}$ between 150° C. and 190° C. for a hold time $t_{base}$ between 10 h and 48 h.

15. Production method according to claim 10, wherein at the conclusion of the hold at $T_{OA}$, the sheet is hot dip coated in a liquid bath of one of the following elements: aluminum, zinc, aluminum alloy or zinc alloy.

16. Production method according to claim 10, wherein a microstructure of the sheet after said annealing the sheet the first time comprises, in area percentage, less than 10% polygonal ferrite, with the remainder of the microstructure composed of fresh or tempered martensite.

17. A vehicle part comprising:

a sheet according to claim 1.

18. A vehicle part comprising:

a sheet produced according to the production method according to claim 10.

* * * * *